US010531739B2

(12) United States Patent
Ostwald et al.

(10) Patent No.: US 10,531,739 B2
(45) Date of Patent: Jan. 14, 2020

(54) ACTIVE DYNAMIC SEATING FURNITURE

(71) Applicant: aeris GmbH, Haar bei Muenchen (DE)

(72) Inventors: Andreas Ostwald, Haar bei Muenchen (DE); Dietlind Walger-Hutter, Haar bei Muenchen (DE)

(73) Assignee: aeris GmbH, Haar bei Munich (DE)

( * ) Notice: Subject to any disclaimer, the term of this patent is extended or adjusted under 35 U.S.C. 154(b) by 0 days.

(21) Appl. No.: 15/837,316

(22) Filed: Dec. 11, 2017

(65) Prior Publication Data

US 2018/0235367 A1 Aug. 23, 2018

(30) Foreign Application Priority Data

Feb. 22, 2017 (DE) ..... 10 2017 103 651

(51) Int. Cl.

| | |
|---|---|
| ***A47C 3/02*** | (2006.01) |
| ***A47C 7/14*** | (2006.01) |
| ***F16F 3/04*** | (2006.01) |
| ***A47C 3/023*** | (2006.01) |
| ***A47C 3/025*** | (2006.01) |
| ***A47C 3/12*** | (2006.01) |

(52) U.S. Cl.

CPC ..... *A47C 3/023* (2013.01); *A47C 3/0252* (2013.01); *A47C 3/12* (2013.01); *A47C 7/14* (2013.01)

(58) Field of Classification Search

CPC ..... A47C 3/023; A47C 3/0252; A47C 3/025; A47C 3/027; A47C 7/02; A47C 7/28; A47C 7/287; A47C 4/20; A47C 4/28; F16F 3/04; B60N 2/508; B60N 2/54

USPC ..... 267/131, 133

See application file for complete search history.

(56) References Cited

U.S. PATENT DOCUMENTS

| | | | | | |
|---|---|---|---|---|---|
| 15,126 | A * | 6/1856 | Fiester | B60N 2/40 | 267/133 |
| 164,811 | A * | 6/1875 | Coates | B60N 2/40 | 267/133 |
| 182,845 | A | 10/1876 | Mohr | | |
| 386,849 | A * | 7/1888 | Rippon | A47C 7/30 | 267/89 |
| 805,846 | A * | 11/1905 | Flindall | A47C 1/143 | 297/19 |
| 821,055 | A * | 5/1906 | Ordway | F16F 15/02 | 248/618 |
| 1,412,396 | A * | 4/1922 | Fixsen | A47C 3/025 | 248/398 |
| 1,570,096 | A * | 1/1926 | Stransky | A47C 3/025 | 297/302.4 |

(Continued)

FOREIGN PATENT DOCUMENTS

| | | |
|---|---|---|
| DE | 20 2006 005 403 U1 | 6/2006 |
| DE | 202011000805 U1 | 10/2011 |
| EP | 1839530 A1 | 10/2007 |

*Primary Examiner* — Thomas J Williams

*Assistant Examiner* — James K Hsiao

(74) *Attorney, Agent, or Firm* — Scully Scott Murphy and Presser

(57) ABSTRACT

The invention relates to a rocker mechanism for an active dynamic seating furniture with a seat surface (2) and with a supporting frame (10), which bears the seat surface (2), wherein the supporting frame (10) is designed with the spring-loaded rocker mechanism (20) and in this way the seat surface (2) is mounted movably sprung on the supporting frame (10).

11 Claims, 8 Drawing Sheets

(56) References Cited

Figure 1:
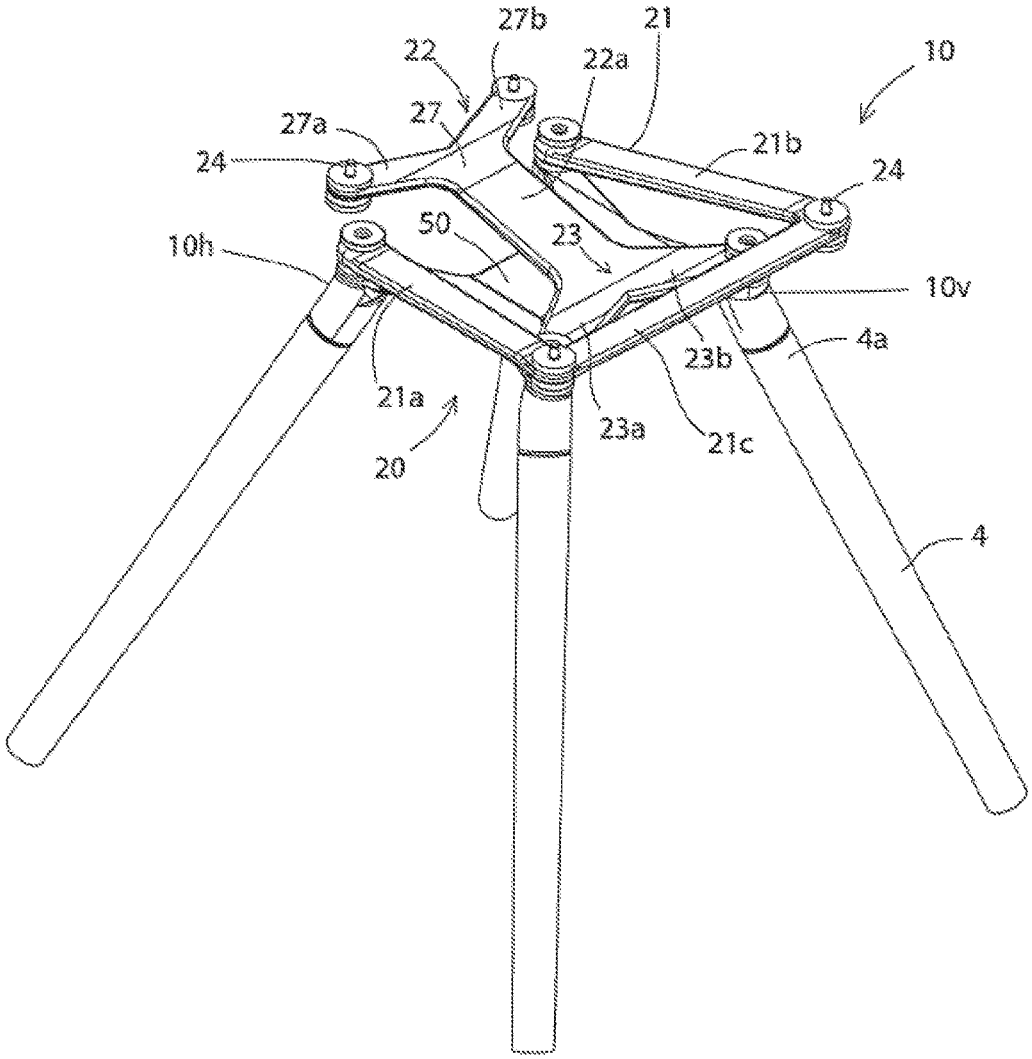

U.S. PATENT DOCUMENTS 1,647,247 A * 11/1927 Pallenberg ..... B60N 2/508 248/588
1,762,788 A * 6/1930 Noelle ..... B60N 2/508 248/628
1,875,500 A * 9/1932 Roeder ..... B60N 2/502 248/584
1,962,464 A * 6/1934 Richtstelg ..... A47C 3/021 248/573
1,971,085 A * 8/1934 Tissler ..... B60N 2/502 248/578
2,083,716 A * 6/1937 Klar ..... A47C 3/0252 248/188.1
2,084,310 A * 6/1937 Breuer ..... A47C 3/021 297/295
2,132,291 A * 10/1938 Fitos ..... A47C 3/025 248/415
2,241,115 A * 5/1941 Burke ..... A47C 3/023 297/295
2,311,384 A * 2/1943 Harpstrite ..... A47C 3/0255 248/580
2,316,628 A * 4/1943 Schaffner ..... A47C 7/028 244/76 R
2,529,613 A * 11/1950 Kirkwood ..... A47C 3/025 248/370
2,828,801 A * 4/1958 Papst ..... A47C 3/021 248/629
2,855,978 A * 10/1958 Hamilton ..... A47D 13/107 248/188.1
3,013,764 A * 12/1961 Kuhn ..... A63G 19/02 248/628
3,039,818 A * 6/1962 Frank ..... A47C 1/026 297/264.1
3,690,725 A * 9/1972 Faulkner ..... A47C 3/025 297/259.1
5,152,582 A * 10/1992 Magnuson ..... A47C 3/12 297/440.2
7,156,468 B2 * 1/2007 Neil ..... A47C 3/025 16/2.1
D821,791 S * 7/2018 Smith ..... D6/708
2003/0071502 A1 * 4/2003 Marshall ..... A47C 1/03255 297/302.1
2004/0113471 A1 * 6/2004 Rivera ..... A47C 3/021 297/258.1
2010/0060057 A1 * 3/2010 Ballendat ..... A47C 3/0252 297/258.1
2014/0252823 A1 * 9/2014 Risdall ..... A47C 7/448 297/239

* cited by examiner

ACTIVE DYNAMIC SEATING FURNITURE

The invention relates to a rocker mechanism for an active dynamic seating furniture, especially a seat or a chair, in order to make possible a rocking motion of the seat of the seating furniture, as well as a seating furniture which is outfitted with such a rocker mechanism.

Forward and backward tiltable or movable seating devices and chairs are already known, for example, as standing-up aids. In the customary design, they have electrically assisted elements such as servo motors, gas pressure cylinders, springs or other lifting devices. These are controlled by the user or another person and assist the user of the furniture by reducing the effort and physical movement when getting out of the seated position. Such solutions thus far are usually realized by movement processes on cam tracks about a fixed axis of rotation. In order to achieve the greatest possible mobility for the elderly and movement-impaired persons when standing up and sitting down, known products such as riser chairs, autonomous standing-up aids for chairs and the like are used primarily.

However, these mechanisms are designed to simplify the getting up from the seated position, and not to perform dynamic movements while seated. But besides this assistance function, there is also an increasing need for movement possibilities of a seated person on a chair. In particular, such movements should be possible while seated which enable an improved blood flow in the legs, a changing of the sitting position, a changing of the posture, and so on.

Chairs are also known in practice where the seat surface along with the back rest can be tilted backward about a tilting axis, for example between a working position and a so-called relaxed position. The tilting hardware required for this is often expensive and demands a substantial structural height, so that for example on office chairs and similar functional chairs such hardware is accepted, but in the household or private domain such hardware is often undesirable for purely esthetic considerations. Moreover, such seats do not possess any movement possibilities in the sense of the present invention. The principal aim is to allow an active dynamic forward and backward movement and preferably also a movement in the sideways direction by the user seated on the seat.

Furthermore, there is a known difficulty in coordinating the mobility between the seat surface and the back rest. For example, it is known how to provide two regions which are movable with respect to each other in the back rest as well, so that an upper section of the back rest can be bent backward with respect to a lower section.

For example, there is known from DE 202011000805 U1 a chair with a seat surface and a back rest, as well as a subframe which carries the seat surface and the back rest, wherein the seat surface is mounted so as to be tiltable relative to the subframe about a horizontal tilt axis, and the back rest has two regions arranged one above the other and able to move relative to each other, whose upper region can be bent relative to the lower region about a tilt axis likewise placed horizontally. But this solution serves for a different adjustability of the tilting movement of the seat surface and the back rest, so that the tilting mobility of the seat surface and the tilting mobility of the back rest are possible in particular depending on the body weight of the user, making possible an adjustment of the activating forces for the tilting movements of the seat surface and the back rest.

However, the tilting and adjustment mechanism proposed for this is expensive and complex, resulting in high costs for such a chair.

Accordingly, there is a need to provide a chair with a stable, yet easily manufactured tilting mechanism, one which can be used especially for different shapes of a seat shell and types of chairs. Moreover, the mechanism should be designed as attractive as possible, so that these chairs can also be used in the private residential sector or in areas with a certain demand for an appealing design. Moreover, the invention should achieve a movement pattern which is best suited to a dynamic sitting in terms of physiognomy.

Therefore, the problem which the invention proposes to solve is to solve the aforementioned problems and to provide a chair with a rocker mechanism having the additional features of being esthetically appealing, simple and economical in its manufacture, and also ensuring adequate stability during movement for users of heavier body weight.

This problem is solved by the combination of features of claim 1.

A basic idea of the invention consists in providing an elastically spring-loaded rocker mechanism, on which a seat portion is secured, in order to make possible active dynamic movements of the seated person. The rocker mechanism according to the invention is formed by lever arms arranged in opposite directions, preferably intersecting each other, by means of which a forward and backward rocking movement with the seat portion, and also preferably to the side, can be accomplished.

For this, according to the invention, a rocker mechanism for a seat is provided, as well as a seating furniture with such a rocker mechanism. When used on a chair, the chair is designed with a supporting frame, which carries the seat portion with a seat surface, while the supporting frame is designed with the spring-loaded rocker mechanism and in this way the seat portion is mounted movably sprung on the supporting frame, so that rocking movements of the seat portion can be performed. The movement of the seat which is connected to such a rocker mechanism may be described as a rocking motion with an axis of rotation dynamically shifting back and forth.

The spring-loaded rocker mechanism forms a first stirrup comprising at least one lever arm, which is connected to a rear portion of the supporting frame, as well as a second stirrup with at least one lever arm, which is connected to a front portion of the supporting frame, while the lever arm or arms of the first stirrup extend substantially in a forward oriented direction (slanting upward), while the lever arm or arms of the second stirrup extend in a substantially backward oriented direction (slanting upward).

This produces an intersecting of the lever arms of the two stirrups.

In a preferred embodiment of the invention, the seat portion (or the underside of the seat portion) is held on the spring-loaded rocker mechanism such that the seat surface can be activated from a starting position into both a forward and a backward tilted position against the spring force of elastic elements. In a forward rocking, the front edge of the seat portion is moved downward, while the rear edge of the seat portion remains in its relative height position or is moved upward, so that a back rest connected to the seat portion is inclined forward. During a backward tilting, the rear edge of the seat portion moves downward, while the rear edge of the seat portion remains in its relative height position or is moved downward, so that a back rest connected to the seat portion is inclined backward. During this rocking forward and backward movement, the elastic elements at which the lever arms are secured are elastically deformed. For this, preferably elastically deformable disks or elastic spacer elements are arranged on the stirrups or on the lever arms at the connection positions with the seat portion and also preferably at the connection positions with a supporting frame or a girder. The elastic elements may also be formed from several separate elastic elements, which are placed in suitable arrangement one on top of another at the fastening points or connection positions to the chair portion and supporting frame. The lever arms are advantageously "sandwiched" between at least two elastically deformable elements. Further, it is advantageous for the prestressing or the elasticity and/or spring property of the elastically deformable elements to be adjusted by means of an activation device or adjusting device, so that this has an immediate effect on the motion characteristics of the rocking movement.

Especially suitable is a configuration in which fastening points are preferably mounted on the first and second stirrup or are provided with elastic spacer disks on which the seat portion is fastened.

In another advantageous embodiment of the invention, at least one of the stirrups has two lever arms and the two lever arms of this stirrup are joined together in U-shape by a connection arm.

Further, it is advantageously provided that both stirrups each have two lever arms and these are each joined together in U-shape by a connection arm. Preferably the stirrup protrudes through the U-shaped opening of the other stirrup at a slant, so that the lever arms of the stirrups cross each other.

In a likewise advantageous embodiment of the invention, it is provided that the other stirrup has a holding section consisting of two holding arms by which the stirrup is connected to the front part of the supporting frame and one lever arm extends away from the holding section, slanting upward in a direction substantially toward the rear portion.

In one preferred embodiment, the supporting frame has four chair legs, running at a slant to each other from bottom to top (preferably forming a pyramidal shape) and the stirrups are connected to them directly or indirectly at the upper ends of the chair legs.

A direct connection can occur, e.g., by a head plate connecting the upper ends of the chair legs or an H-shaped connection structure, from which mounting bolts or connection elements are arranged, at which or by which the respective stirrups are secured to their holding sections.

Especially advantageous is a design of a supporting frame in which the course of the first stirrup is configured as follows:

- a holding section of the first lever arm is fastened directly above the first, e.g., the rear chair leg or connected to it directly or indirectly by elastically deformable bearing elements (disks);
- the lever arm then runs slanting upward and forward to a first fastening point for the seat portion, at which likewise at least one elastically deformable bearing for the seat portion is arranged;
- from this first seat portion fastening point of the first stirrup runs a connection arm of the stirrup to a second seat portion fastening point adjoining the second lever arm of the stirrup (here again at least one elastically deformable bearing is provided in the direction of the chair at the fastening point);
- the second lever arm runs in the direction toward a second (accordingly) rear chair leg slanting downward and backward (so to speak, roughly parallel with the first lever arm) and is fastened by its holding section directly above the second rear chair leg across an elastically deformable bearing or connected to it indirectly by the latter.

In this way, a U-shaped stirrup is obtained, which is fastened by its respective holding sections each time directly above the two rear chair legs.

It is furthermore advantageous for the course of the second stirrup to be configured as follows:

- two holding arms of the second stirrup form a holding section with two fastening points, outfitted with elastically deformable bearing elements, for this stirrup and these are fastened each time at the end directly above a respective front chair leg or connected each time to the latter indirectly across elastic bearings;
- a lever arm adjoins the holding section and runs slanting backward and passes into a V-shaped fastening section for the seat portion, consisting of two fastening arms at whose ends are arranged each time elastically deformable bearings and fastening points for the seat portion.

In this way, a roughly H-shaped stirrup is obtained, which is fastened each time by its holding sections at the supporting frame side directly above the two front chair legs.

Thus, the one stirrup slants upward and backward and the other stirrup slants upward and forward and the lever arms of the two stirrups cross each other in between.

It is thus provided with advantage that the two stirrups are fastened by their respective holding sections indirectly across elastically deformable bearings at connection means, preferably making use of elastically deformable spacer disks on the supporting frame, each time in the region of the ends of the chair legs, so that the elastic properties for the rocking motion come at least partly or predominantly from the elastic deformability of the elastic spacer disks or elastically deformable spacer elements. For this, there are preferably provided each time a lower elastically deformable bearing and an upper elastically deformable clamping disk at the respective fastening points, between which the holding section of the respective stirrup is secured and so to speak "sandwiched".

In comparable manner are also formed the fastening points for the fastening of the seat portion. A terminal section of the respective stirrup is clamped between an elastically deformable spacer element at the seat portion side and an elastically deformable clamping disk and likewise "sandwiched" in this way.

The desired elasticity of the rocker mechanism can accordingly be adjusted depending on the material and geometry of the elastic elements involved.

In another preferred embodiment of the invention the supporting frame and the rocker mechanism are formed as a single piece, preferably from a tubular material. The tubular frame so obtained likewise has two U-shaped stirrups. To the cross links of the U-shaped stirrup the seat portion is fastened across elastically deformable bearing elements as described above.

Figure 2:
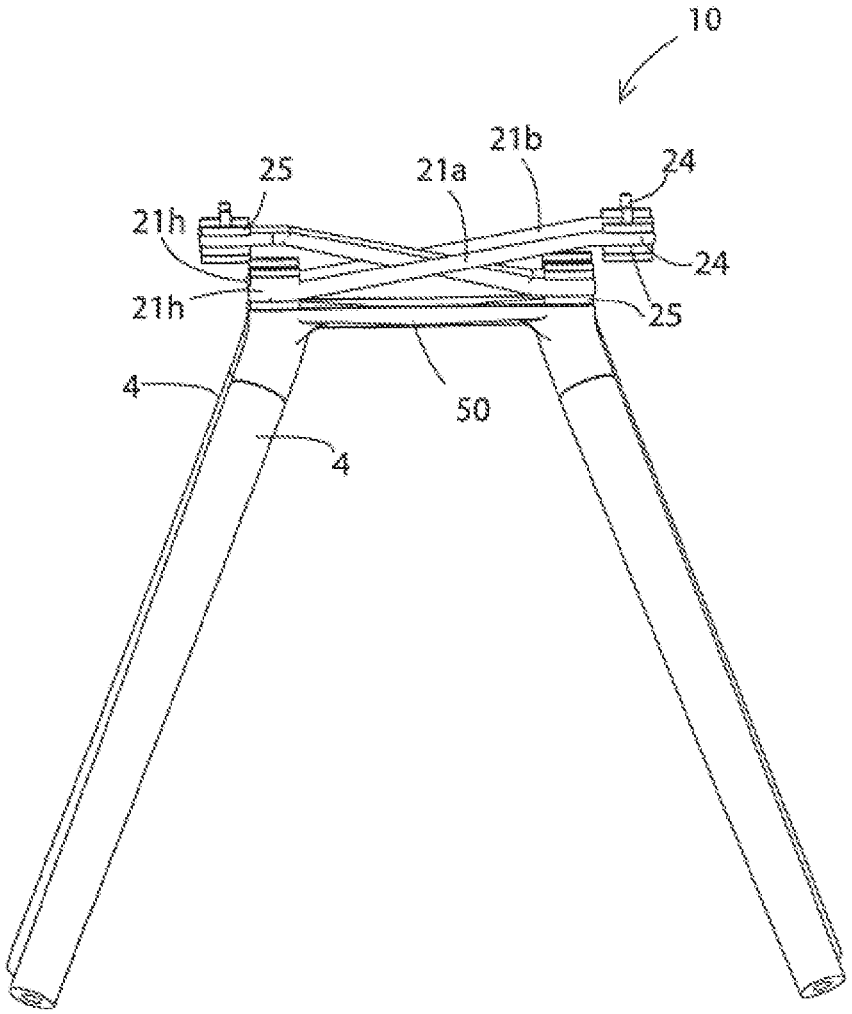
Figure 3:
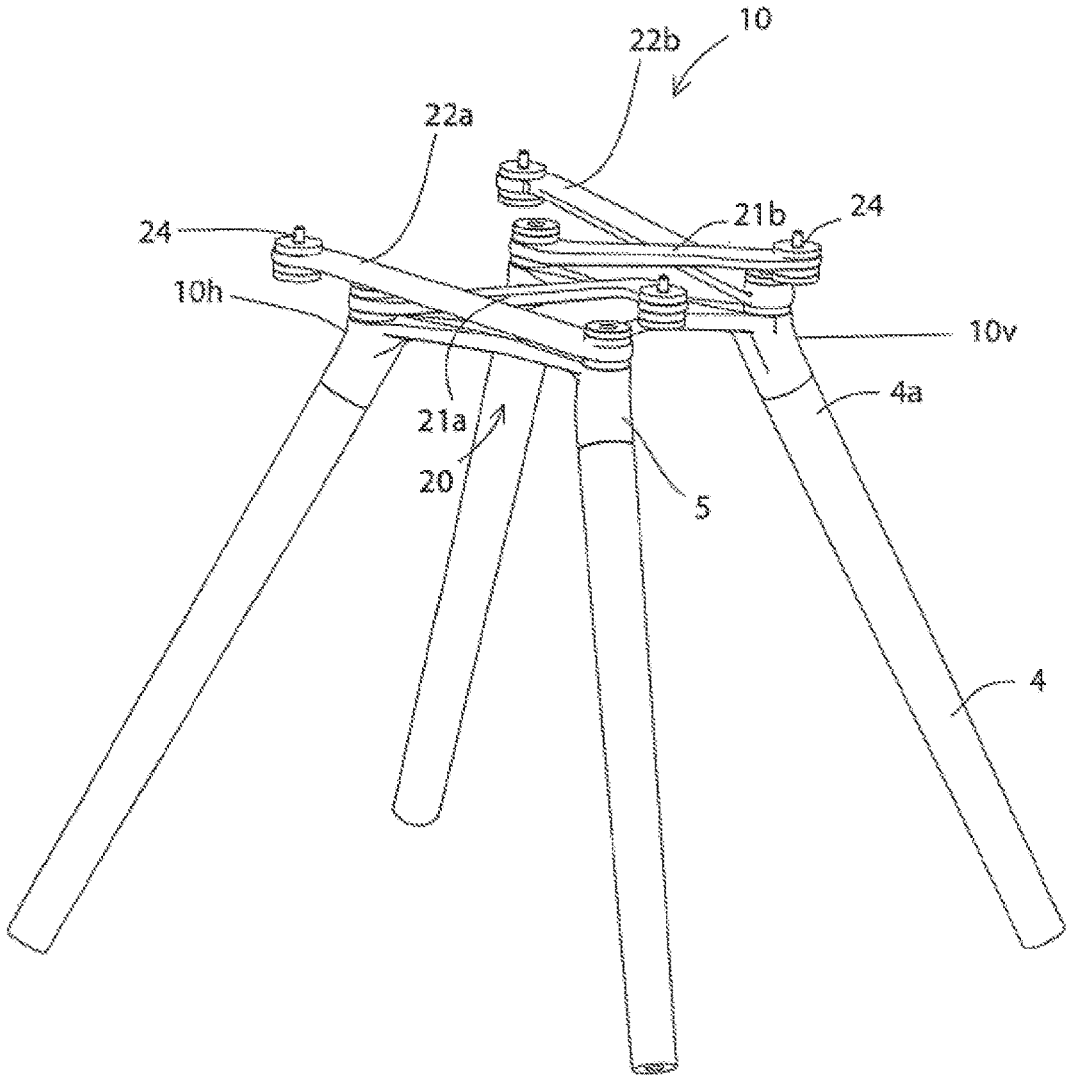
Figure 4:
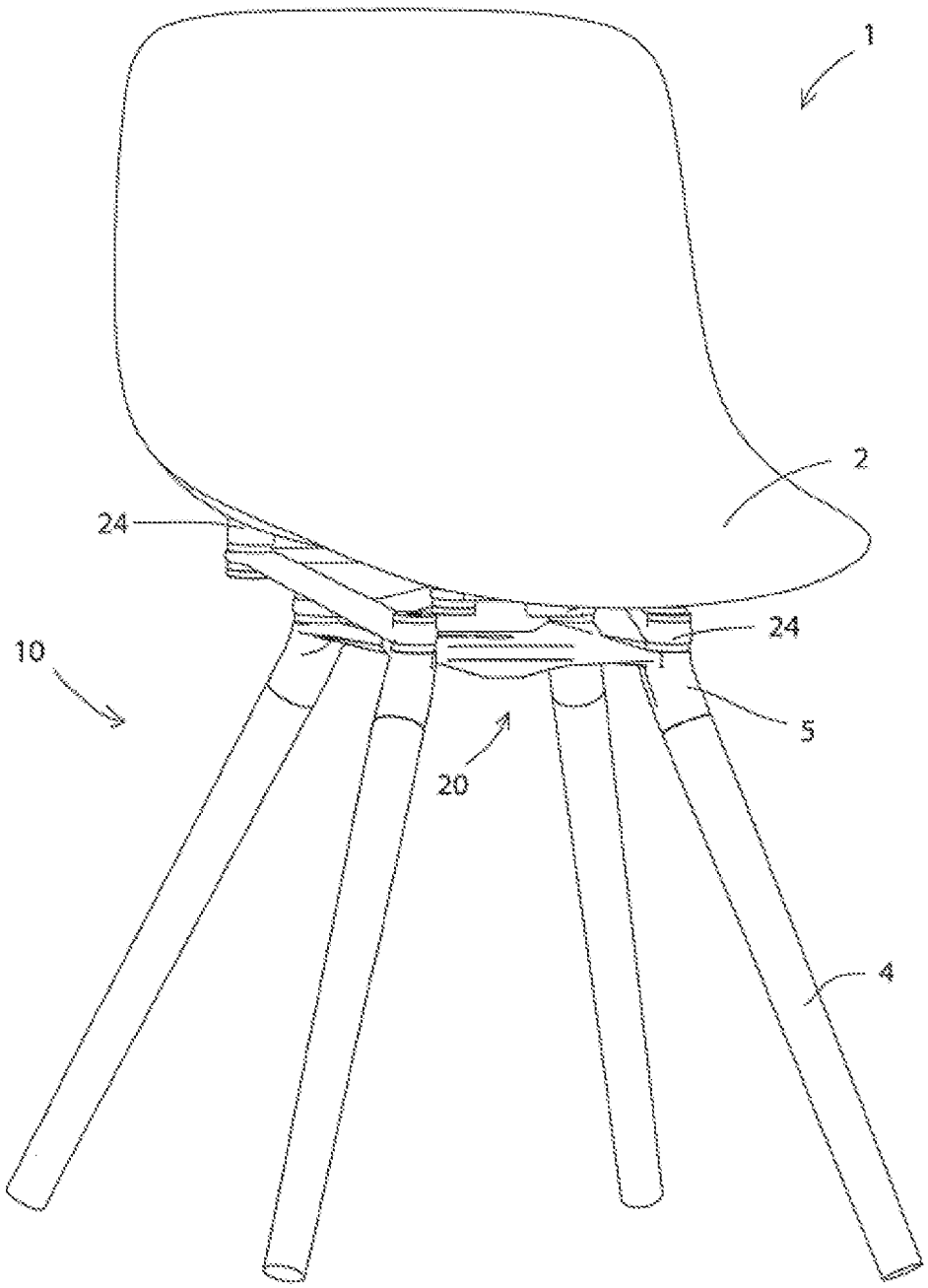
Figure 5:
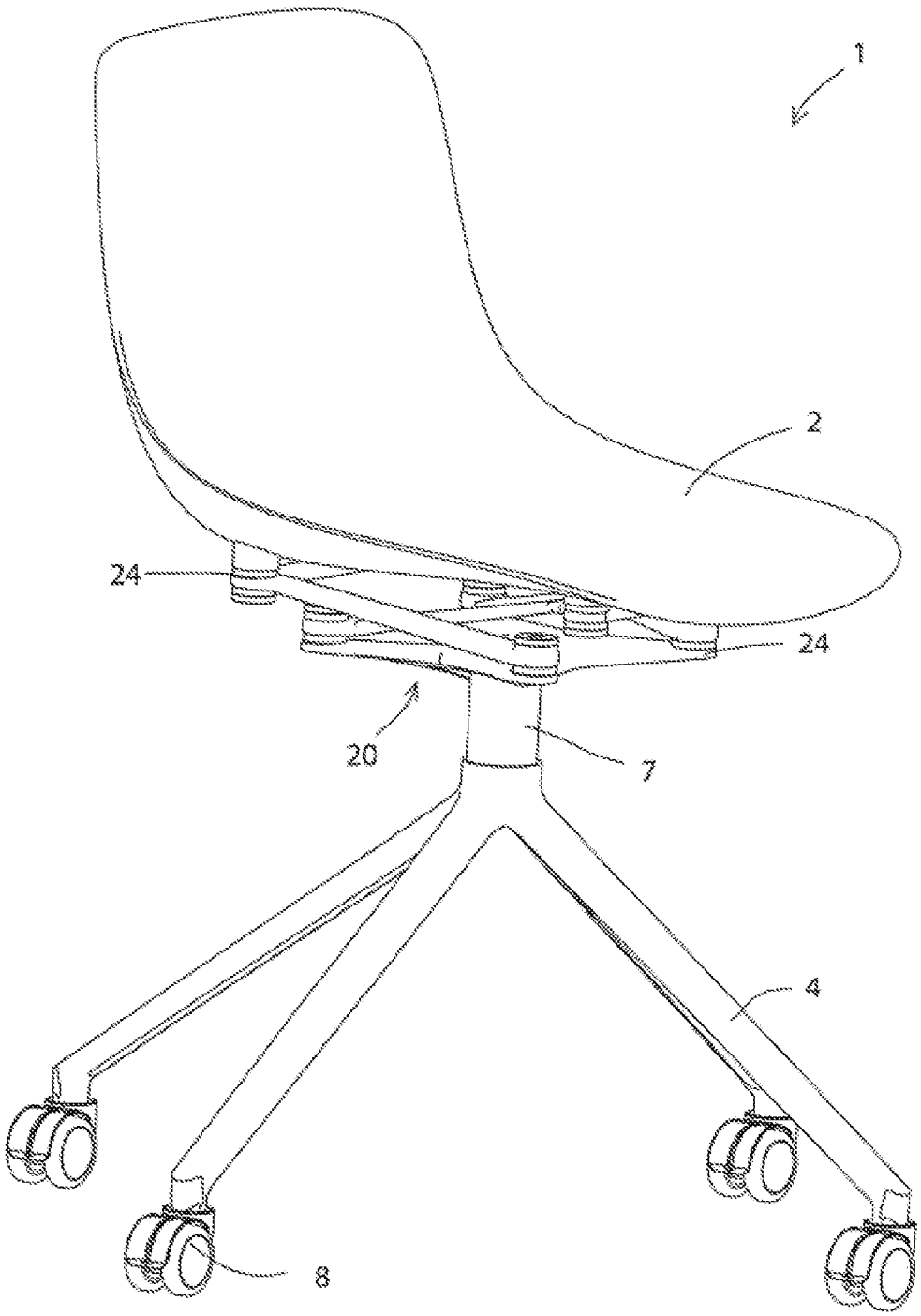
Figure 6:
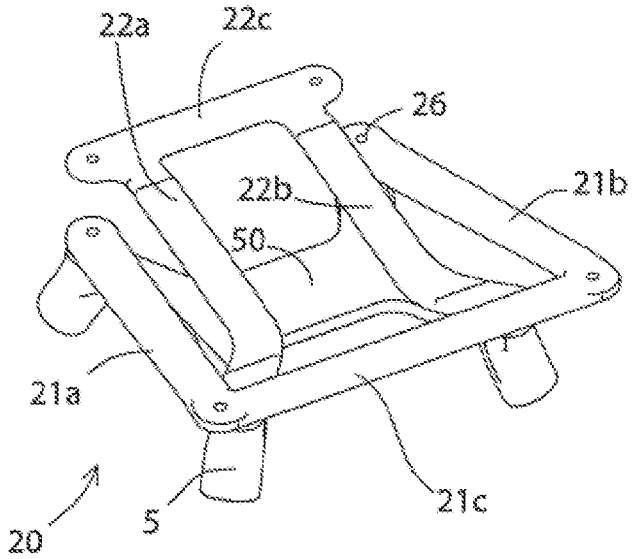
Figure 7:
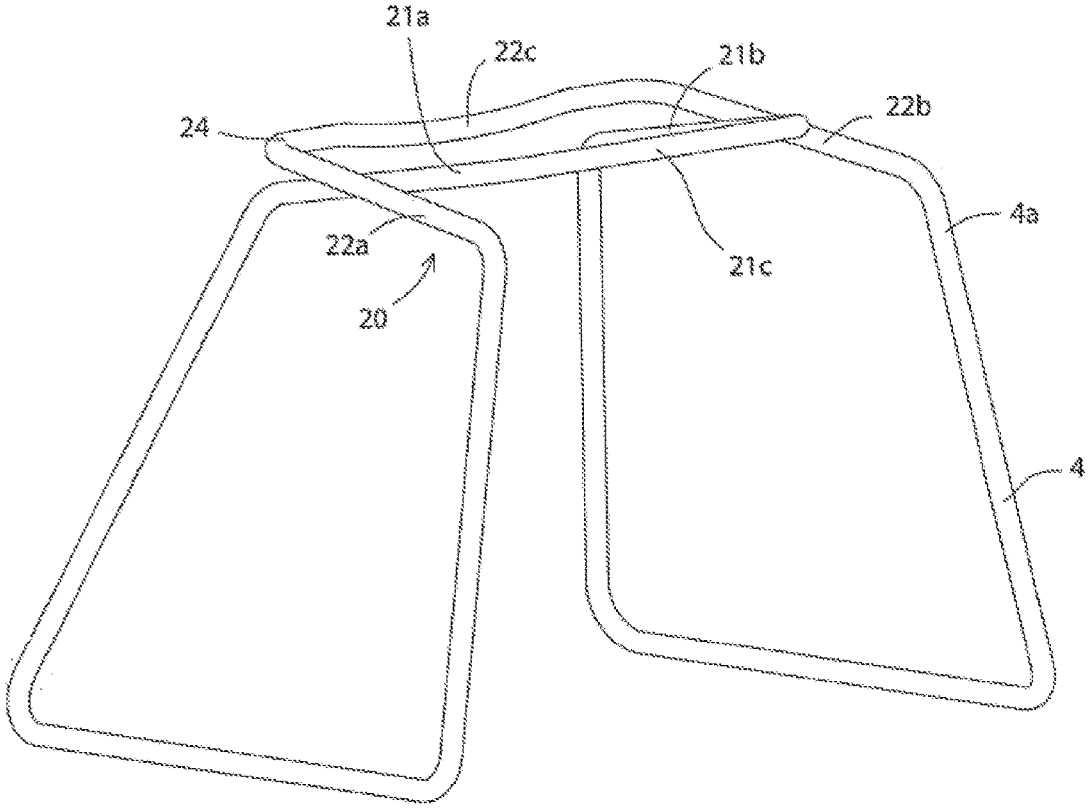
Figure 8:
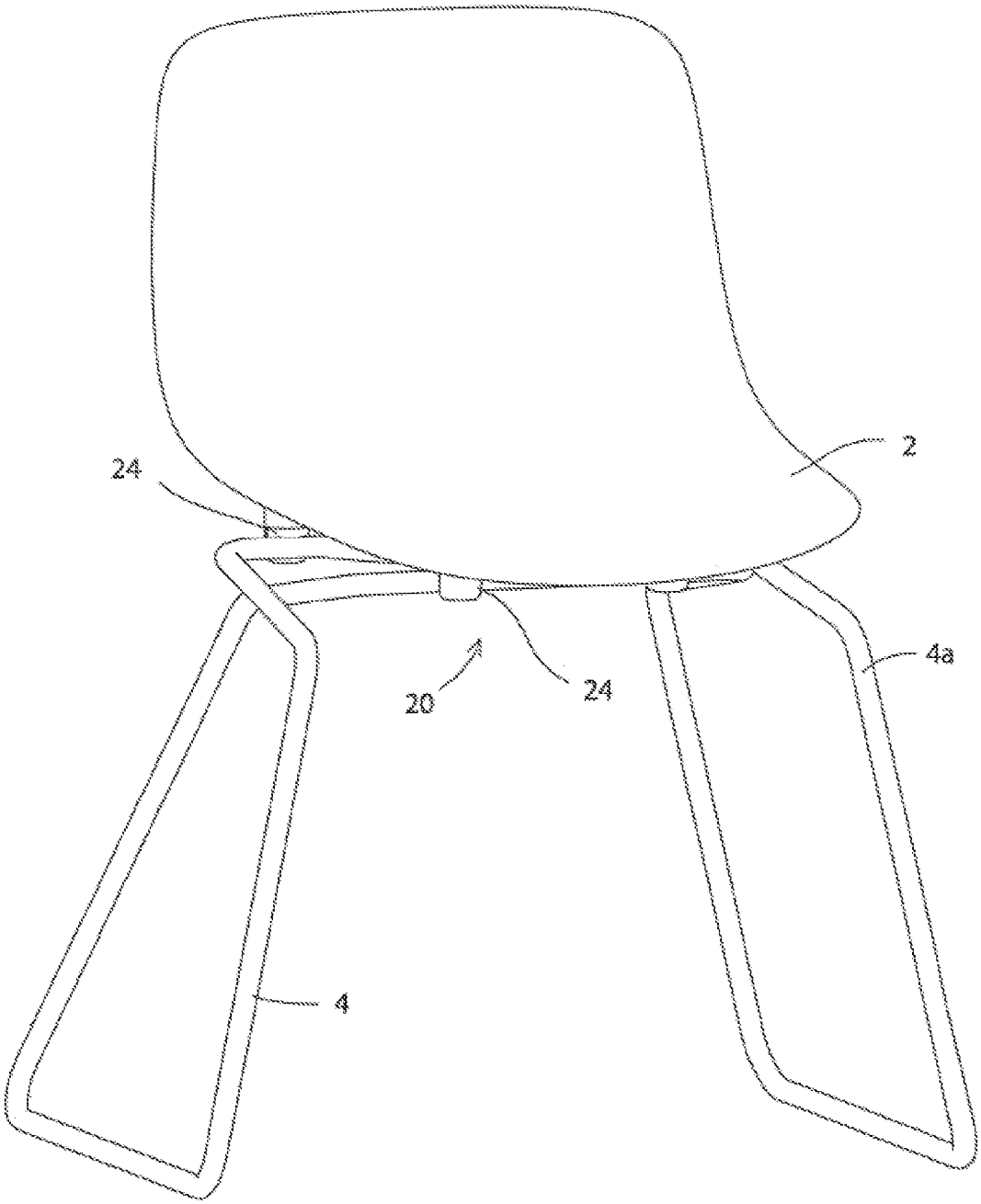

Other advantageous modifications of the invention are characterized in the dependent claims and shall be represented more closely below together with the description of the preferred embodiment of the invention by means of the figures. There are shown:

FIG. 1 a sample embodiment of a perspective view of a rocker mechanism;

FIG. 2 a side view of an alternative rocker mechanism;

FIG. 3 an alternative sample embodiment of a perspective view of a rocker mechanism;

FIG. 4 a chair with a tilting device according to the invention;

FIG. 5 an alternative design of a chair with rollers with a tilting device according to the invention;

FIG. 6 an alternative sample embodiment of a perspective view of a rocker mechanism;

FIG. 7 an alternative sample embodiment of a design of a supporting frame with integrated rocker mechanism and FIG. 8 a chair with the supporting frame of FIG. 7.

In the following, the invention shall be described more closely by means of sample embodiments with reference to FIGS. 1 to 8, where the same reference numbers indicate the same structural and/or functional features.

FIG. 1 shows a first sample embodiment of a perspective view of a rocker mechanism 20 and FIG. 2 shows a side view of an alternative rocker mechanism 20.

The rocker mechanism 20 is designed to be arranged on or integrated in a supporting frame 10, as shown in FIG. 1. In this context, refer to FIGS. 4 and 5 in which each time an active dynamic chair 1 is shown with a seat surface 2 and with a supporting frame 10, which bears the seat surface 2, while the supporting frame 10 is designed with a spring-loaded rocker mechanism 20.

Thanks to such a design, the seat surface 2 or the entire seat with the seat surface 2 is mounted movably sprung and tiltable on the supporting frame 10 without the need for a pendulum column.

The spring-loaded rocker mechanism 20 comprises a first stirrup 21 consisting of two lever arms 21*a*, 21*b*, each of which is connected to a rear portion 10*h* of the supporting frame 10.

Moreover, the rocker mechanism 20 comprises a second stirrup 22 with a lever arm 22*a*, which is connected to a front portion 10*v* of the supporting frame 10.

One will notice that the two lever arms 21*a*, 21*b* of the first stirrup 21 extend substantially in a forward oriented direction, while the lever arm 22*a* (or the two lever arms 22*a*, 22*b* in the embodiment of FIG. 6) of the second stirrup 22 extend in an opposite direction, substantially oriented to the rear. By the terms "rear" in the sense of the present invention is meant each time the region in relation to the chair where the back rest or the rear chair legs are situated, while "front" defines the opposite region on the chair, as also emerges from the figures.

In a general description, one may describe the course of the first stirrup 21 as follows:

- a holding section 21*h* of the first lever arm 21*a* is fastened directly above a rear chair leg 4 or connected to it directly or indirectly;
- the lever arm 21*a* then runs slanting upward and forward to a first fastening point 24 for the seat portion 2;
- from the first seat portion fastening point 24 runs a connection arm 21*c* of the stirrup 21 to a second seat portion fastening point 24 adjoining the second lever arm 21*b* of the stirrup 21;
- the second lever arm 21*b* runs in the direction toward a second rear chair leg 4 slanting downward and backward and is fastened by its holding section 21*h* directly above the second rear chair leg 4 or connected to it directly or indirectly by the latter.

In a general description, one may describe the course of the first stirrup 22 as follows (see FIG. 1):

- two holding arms 23*a*, 23*b* which form a holding section 23 of the stirrup 22 are fastened each time at the end directly above a front chair leg 4 or connected to the latter indirectly;
- a lever arm 22*a* runs slanting backward and passes into a V-shaped fastening section 27, consisting of two fastening arms 27*a*, 27*b* at whose ends are arranged each time fastening points 24 for the seat portion 2.

The active dynamic chair 1 is preferably designed such that the seat surface 2 is held movably sprung on the spring-loaded rocker mechanism 20 across the elastically deformable spacer disks 25, so that the seat surface 2 can be activated from a starting position in both a forward and a rearward tilted position against the spring force of the elastically deformable spacer disks 25.

In FIGS. 1 and 2 is represented an embodiment in which the two lever arms 21*a*, 21*b* of the first stirrup 21 are connected by a connection arm 21*c*, so that the stirrup 21 has a U-shaped configuration.

FIG. 6 shows an alternative sample embodiment of a perspective view of a rocker mechanism 20 in which the two lever arms 22*a*, 22*b* of the second stirrup 22 are also connected by a connection arm 22*c*, so that the stirrup 22 likewise has a U-shaped configuration.

In the embodiment of FIGS. 1 and 2, the second stirrup 22 has a holding section 23, consisting of two holding arms 23*a*, 23*b*, by which the stirrup 22 is connected to the front part 10*v* of the supporting frame 10 and one lever arm 22*a* extends away from the holding section 23, slanting upward in a direction substantially toward the rear portion 10*h*.

On the first and second stirrup 21, 22 there are formed fastening points 24 with elastically deformable spacer disks 25, to which is fastened on the one hand the seat portion 2 and which on the other hand produce the connections of the lever arms of the stirrup 21, 22. The stirrups 21, 22 may have a single-piece or alternatively a multiple-piece configuration (e.g., being composed of three individual lever arms).

Moreover, the supporting frame 10 in the embodiments depicted has four chair legs 4, which run from bottom to top, slanting toward each other. The stirrups 21, 22 are connected at the upper ends 4*a* of the chair legs 4 indirectly to the latter across chair leg connections 5. FIG. 5 shows an alternative solution, in which the rocker mechanism 20 is mounted on a central chair column 6, adjoined by an otherwise known foot cross 7 with rollers 8. The legs 4 of the foot cross 7 likewise run at a slant, as in the example of FIG. 4.

In FIG. 6 one can see how the chair leg connections 5 are an integral component of the stirrup 20.

The two stirrups 21, 22 are fastened by their respective holding sections indirectly across connection means 26 and making use of elastic spacer disks 25 to the supporting frame 2, each time in the region of the chair leg ends 4*a*.

The supporting frame 2 of FIG. 2 is moreover connected to four chair legs 4, die which run from bottom to top slanting toward each other and are joined together at the upper chair leg ends 4*a* by means of a connection plate 50. On the connection plate 50 are formed directly the four chair leg connections 5 as a single piece. The chair leg connections 5 are fashioned as cylindrical tubular elements in whose open end the ends 4*a* of the chair legs 4 are inserted and secured. An especially easy assembly can by accomplished by a press fit, so that no mechanical connection materials are required. In addition or alternatively, a bonding method can be used in order to create a mechanical connection between the chair legs 4 and the chair leg connections 5.

As is evident from FIG. 3, for the desired tilting effect 20 by means of the spring-loaded tilting device 20 the lever arms 21*a*, 21*b* and 22*a*, 22*b* of the two stirrups 21, 22 cross each other in roughly the shape of an X, as seen from the chair side. A comparable configuration is easily noticed in the side view of FIG. 2, where one notices the X-shaped arrangement of the two stirrups 21, 22.

FIGS. 7 and 8 show another alternative sample embodiment of the invention, in which the supporting frame 2 and the rocker mechanism 20 are formed integrally or as a single piece from tubular material. The concept of the invention is likewise realized here by the two spring stirrups 21, 22, which in this embodiment are also configured in an X-shaped intersecting arrangement.

The invention is not limited in its implementation to the above indicated sample embodiments. Instead, a number of variants are conceivable, which make use of the presented solution even with fundamentally different configurations. Thus, the above described course and orientation of the stirrups may be precisely the reverse or opposite direction, or a mirror image.

The invention claimed is:

1. An active dynamic seating furniture with a spring-loaded rocker mechanism for executing movement for a seat portion having a seat surface of said seating furniture relative to, and arranged on, a supporting frame, wherein the seat portion is mounted movably sprung and tiltable on the supporting frame, wherein the spring-loaded rocker mechanism forms at least one lever arm comprising a first stirrup, which is connectible to a rear portion of the supporting frame, and a second stirrup with at least one lever arm, which is connectible to a front portion of the supporting frame, wherein the seat portion is fastened to the rocker mechanism across elastically deformable bearings, wherein fastening points on the first and second stirrup are provided with elastically deformable spacer disks on which the seat portion is fastened, wherein the supporting frame has four chair legs, running at a slant toward each other from bottom to top and the stirrups are connected to said chair legs directly, or indirectly at the upper ends of the chair legs, and wherein the stirrups are each fastened by their respective holding sections indirectly by connection means provided with elastically deformable spacer disks on the supporting frame in the region of each of the chair leg upper ends.

2. The active dynamic seating furniture as claimed in claim 1, wherein the lever arm or arms of the first stirrup extend substantially in a forward oriented direction, while the lever arm or arms of the second stirrup extend in a substantially backward oriented direction and they intersect each other.

3. The active dynamic seating furniture as claimed in claim 1, wherein the seat portion is held with the seat surface on the spring-loaded rocker mechanism such that the seat surface can be activated from a starting position into both a forward and a backward tilted position against the spring force of the elastically deformable bearings.

4. The active dynamic seating furniture as claimed in claim 1, wherein at least one of the stirrups has two lever arms and the two lever arms of this stirrup are joined together in U-shape by a connection arm.

5. The active dynamic seating furniture as claimed in claim 1, wherein both stirrups have two lever arms and the two lever arms of the respective stirrup are each joined together in U-shape by a connection arm.

6. The active dynamic seating furniture as claimed in claim 1, wherein the other stirrup has a holding section consisting of two holding arms by which the stirrup is connected to the front part of the supporting frame and one lever arm extends away from the holding section, slanting upward in a direction substantially toward the rear portion.

7. The active dynamic seating furniture as claimed in claim 1, wherein the supporting frame has four chair legs which run toward each other at a slant from bottom to top and which are joined together at the upper chair leg ends by means of a connection plate.

8. The active dynamic seating furniture as claimed in claim 1, wherein the lever arms of the two stirrups cross each other in X-shape, looking from the chair side.

9. The active dynamic seating furniture as claimed in claim 1, wherein the supporting frame and the rocker mechanism are formed as a single piece.

10. The active dynamic seating furniture as claimed in claim 9, wherein said supporting frame and said rocker mechanism are made of tubular material.

11. The active dynamic seating furniture as claimed in claim 1, wherein the elasticity and/or spring property of the elastically deformable bearings can be altered by means of an adjustment mechanism.

* * * * *